United States Patent [19]

Dobson

[11] 4,121,517

[45] Oct. 24, 1978

[54] TYPE BEARING BAND ASSEMBLY

[75] Inventor: Thomas A. Dobson, Canoga Park, Calif.

[73] Assignee: Dataproducts Corporation, Woodland Hills, Calif.

[21] Appl. No.: 744,599

[22] Filed: Nov. 24, 1976

Related U.S. Application Data

[63] Continuation of Ser. No. 597,391, Jul. 18, 1975, abandoned.

[51] Int. Cl.[2] ..... B41J 9/08; B41J 1/20

[52] U.S. Cl. ..... 101/93.14; 101/111; 400/463

[58] Field of Search ..... 101/111, 93.13, 93.14; 197/36

[56] References Cited

U.S. PATENT DOCUMENTS

| | | | |
|---|---|---|---|
| 2,312,782 | 3/1943 | Thorell | 197/36 |
| 2,384,030 | 9/1945 | Helmond | 197/36 |
| 2,544,169 | 3/1951 | Manning et al. | 101/382 R |
| 2,928,340 | 3/1960 | Stein et al. | 101/120 |
| 3,205,996 | 9/1965 | Greenwood | 101/109 |
| 3,683,802 | 8/1972 | Hepner | 101/111 |
| 3,742,848 | 7/1973 | Huntoon | 101/111 |
| 3,845,711 | 11/1974 | Helms | 101/111 |

OTHER PUBLICATIONS

I. L. Wieselman, "Printer Technology and its Future", Data Products Corp.

I. L. Wieselman, "The Character of Printers", Computer Design, vol. 6, No. 7, p. 47t (Jul. 1974).

*Primary Examiner*—William Pieprz

*Attorney, Agent, or Firm*—Lindenberg, Freilich, Hornbaker, Wasserman, Rosen & Fernandez

[57] ABSTRACT

A type bearing band assembly for use in a high speed impact printer comprising a flexible band having a plurality of cylindrical slugs secured to the band outer surface and extending across the width thereof. Each slug has end faces which open into bores or cavities extending axially into the slug. A plurality of type modules are provided, each including a head having front and rear faces. One or more raised type characters are formed on each module front face. A shank extends from each module rear face through a slug end face and is secured in the slug cavity.

5 Claims, 5 Drawing Figures

TYPE BEARING BAND ASSEMBLY

This is a continuation, of application Ser. No. 597,391, filed July 18, 1975 now abandoned.

BACKGROUND OF THE INVENTION

This invention relates generally to high speed impact printers and more particularly to an improved type bearing assembly for use therein.

U.S. Pat. No. 3,845,711 discloses a high speed impact printer utilizing a flexible band assembly for moving type characters along a row of individually actuatable hammers. The band is supported on a low friction road bed and carries on its outside surface a plurality of parallel elongated slugs extending across the width of the band. Each slug has a type character formed on its end face which can be impacted by an actuated hammer as it moves therepast.

U.S. Pat. No. 3,865,029 discloses a system for generating timing signals in a printer of the type disclosed in the aforementioned U.S. Pat. No. 3,845,711.

SUMMARY OF THE INVENTION

The present invention is directed to an improved type bearing assembly comprised of cylindrical slugs having end faces opening into axially directed bores or cavities. Each cavity is adapted to receive the shank of a type module. Each type module is comprised of a head having a front face on which a type character is formed and a rear face from which the shank extends.

In accordance with a significant feature of the invention, the type module shanks can be removably secured within the slug cavities so as to enable worn type modules on a band to be quickly and simply replaced.

In accordance with a further feature of the invention, the slug cavities are used to properly position the slugs for initially installing them on the band.

DESCRIPTION OF THE PREFERRED EMBODIMENT

Figure 1:
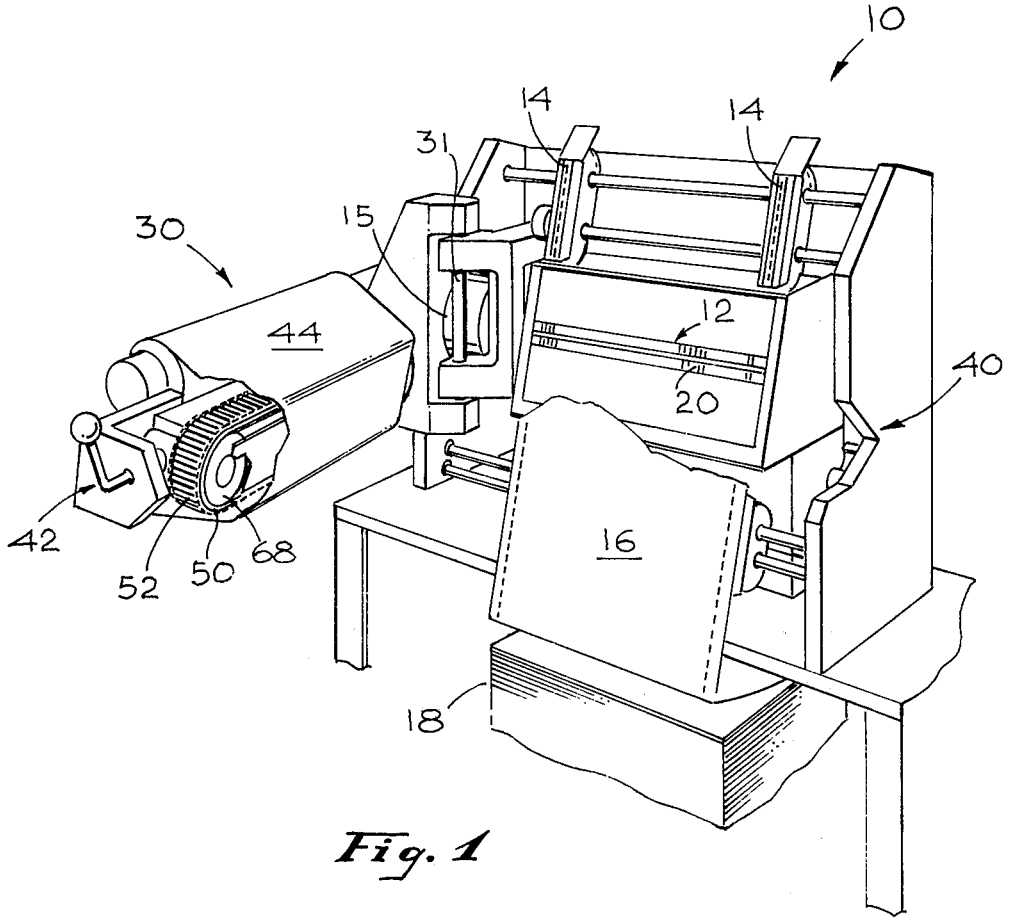
FIG. 1 is a perspective view of a high speed printer incorporating the teachings of the present invention.

Attention is now directed to FIG. 1 which illustrates a high speed impact printer exemplary of the type generally employed for data processing applications. Briefly, the printer of FIG. 1 is comprised of a first frame 10 supporting both a hammer bank assembly 12 and a paper stepping system generally comprised of tractor chains 14, driven by motor 15. The chains 14 pull edge perforated paper 16 from a supply stack 18 past the impact faces 20 of the hammer bank assembly 12. A typical hammer bank assembly is disclosed in U.S. Pat. No. 3,643,595.

The printer of FIG. 1 also includes a second frame 30 which is hinged with respect to the first frame 10 about a hinge pin 31. Cooperating latch mechanisms 40 and 42 are carried respectively by the frames 10 and 30 for locking the frames together in closed operative relationship.

The frame 30 supports a type assembly 32 which includes a movable type bearing surface which presents successive type characters to the hammer impact faces 20. The present invention is directed primarily to an improved type assembly 32 in which the type bearing surface moves horizontally along the line of hammer impact faces. The details of the type assembly in accordance with the invention will be discussed hereinafter subsequent to a brief consideration of the operation of the printer of FIG. 1.

In operation, the edge perforations of the paper 16 are engaged with the sprockets of chains 14 and the frame 30 is in a closed latched position with respect to the frame 10. Movement of the chains by the motor 15 pulls the paper past the hammer impact faces 20, one line at a time. In this closed operative position, the hammer impact faces are disposed very close to the paper 16 which in turn is disposed very close to a printing ribbon 44 carried by frame 30 adjacent to the type assembly 32. As will be seen hereinafter, as the type surface of the assembly 32 is moved, it presents successive type characters to each of the plurality of print stations, i.e. the hammer impact faces. By actuating a hammer at an appropriate time, the hammer impact face is propelled against the back side of the paper 16 forcing the paper against the ribbon 44 and the type surface of assembly 32 to thus print the struck character on the front side of the paper.

Figure 2:
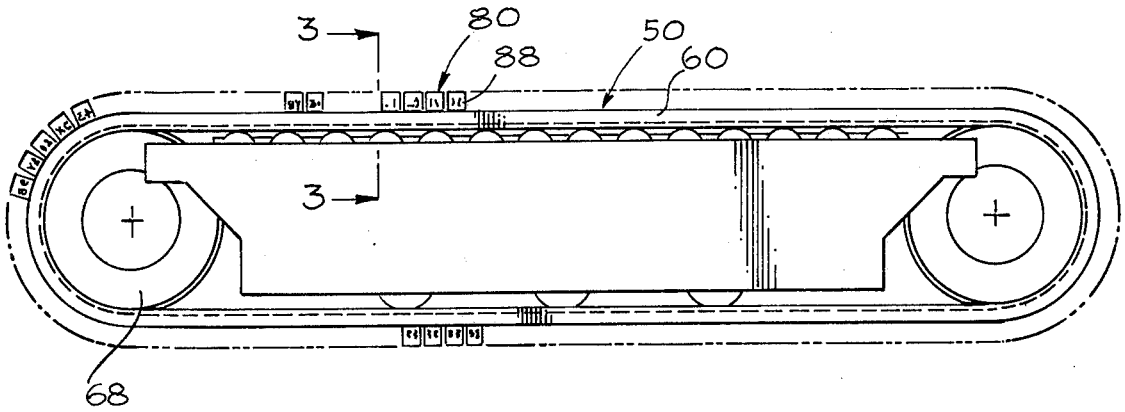
FIG. 2 is a front plan view of a type assembly in accordance with the present invention.

As previously mentioned, the present invention is directed primarily to an improved type assembly 32 for successively presenting characters to be printed to the print stations. Briefly, the type assembly 32 in accordance with the invention is comprised of an endless band 50 supported on a roadbed formed by low friction bearings such as roller bearings. As is disclosed in significantly greater detail in U.S. Pat. No. 3,845,711 the roller bearings bear outwardly against the inner surface of the band 50 with means being provided for driving the band 50 around the roadbed. As can be seen in FIGS. 1 and 2, slugs 52 are carried on the outer surface of the band 50. Each slug 52 carries a type character on at least one end face thereof and as the band 50 is moved around the roadbed along a substantially elliptical path, successive characters on the upper run of the path are presented at each print station.

Figure 3:
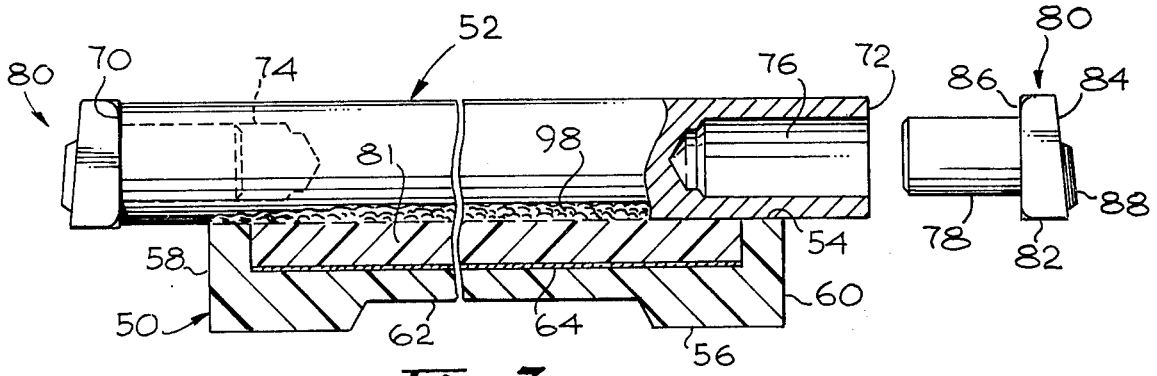
FIG. 3 is a sectional view taken substantially along the plane 3—3 of FIG. 2.

Attention is now called to FIGS. 2 and 3 which illustrate the type assembly 32 in greater detail. The assembly includes an endless band 50 having inner and outer peripheral surfaces 54 and 56. The band 50 preferably has an I shaped cross section, as is best shown in FIG. 3, comprised of enlarged end portions 58 and 60 and a central trough portion 62. The band 50 preferably comprises a plastic material such as polyurethane formed around a flat steel belt 64. As a consequence of this construction, the band 50 will exhibit the desirable characteristics of being relatively flexible about an axis extending parallel to the band's axial direction and being relatively rigid about a line coincident with the circumference of the band.

Each slug 52 is cylindrically shaped and defines end faces 70 and 72. Openings respectively formed in the end faces 70, 72 open into cavities 74, 76. The cavities 74, 76 are cylindrically shaped and are dimensioned to tightly receive a cylindrical shank 76 of a type module 80.

Each type module 80 is comprised of a shank 78 and a head 82. The head 82 has a front face 84 and a rear face 86 from which the shank 78 extends. One or more raised type characters 88 are formed on the front face 84 which is oriented at an angle relative to the shank to permit the entire type assembly to be tilted relative to the plane of hammer faces. Tilting of the type assembly provides greater clearance between the lower run of the band path and the paper path.

The type modules 80 are adapted to be removably mounted on the slugs, as shown in FIG. 3 by inserting the shank 78 through a slug end face into the slug cavity 76 such that the slug abuts the head rear face 86. In order to secure the type module shank 78 in the slug cavity, a heat soluble epoxy (not shown) is used. That is, heated epoxy is applied to the outer surface of shank 78 prior to insertion into the slug cavity 76. After cooling, the epoxy will hold the shank 78 securely within the cavity. In order to remove a type module 80 from a slug, heat can be selectively applied, such as with a conventional soldering gun, to dissolve the epoxy enabling the type module shank 78 to be withdrawn from the slug cavity.

The slugs 52 are selected so as to have a large mass relative to the mass of a hammer in order to minimize the energy transfer from a hammer to a slug upon impact. Preferably, each slug 52 with the type modules 80 mounted therein will have a mass at least 5 to 10 times the mass of a hammer. Typically, the front face 84 of the type module 80 will have a width, that is along the line of hammers, equal to approximately 0.24 inches enabling two type characters to be formed thereon spaced by 0.125 inches center to center. The length of a slug 52 is selected so as to assure sufficient mass within the slug to achieve the aforementioned ratio of slug to hammer mass. Typically, the slug will be approximately 2 inches long. The shank 78 of the type module 80 extends approximately 0.24 inches from the rear face 86 of the type module head 82. The slug cavity 76 extends into the slug approximately 0.25 inches from the slug end face to fully accommodate the shank 78 and enable the slug end face to abut the head rear face 86.

By providing cavities extending axially into the slug 52 from both end faces 70 and 72, the band assembly can simultaneously carry type characters of two different fonts. This enables the font printed by any particular machine to be easily switched merely by reversing the band so as to oppose the hammer faces with characters of a different font. Alternatively, of course, the band assembly can carry characters of the same font on both ends of the slugs. In this event, after one set of type characters become sufficiently worn, the band can be reversed to present a new set of type characters to the hammer faces. As aforedescribed, after the type characters on the front face of a type module head have become sufficiently worn, the type module can be easily removed from the slug by selective application of heat and a new type module can easily be inserted.

Use of slugs 52 in accordance with the present invention having cavities 74, 76 opening into the slugs 52 from both ends thereof, facilitates installation of the slugs onto the flexible band in initially constructing the type assembly.

Figure 4:
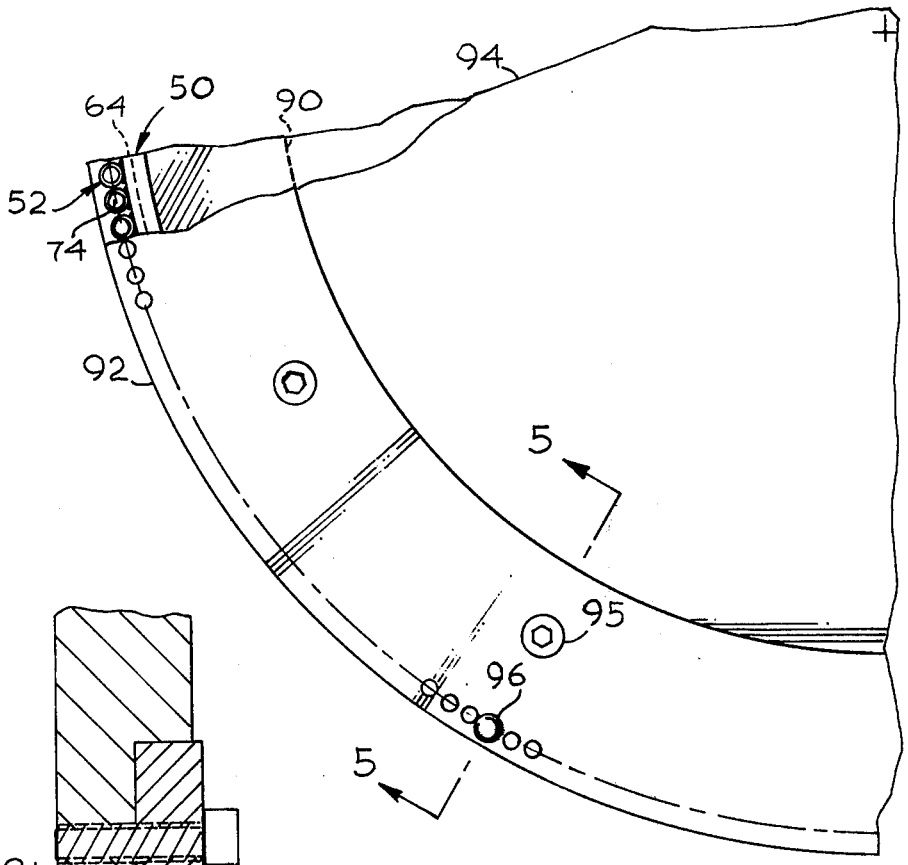
FIG. 4 is a plan view of a fixture useful for installing the slugs on the flexible band in accordance with the invention.
Figure 5:
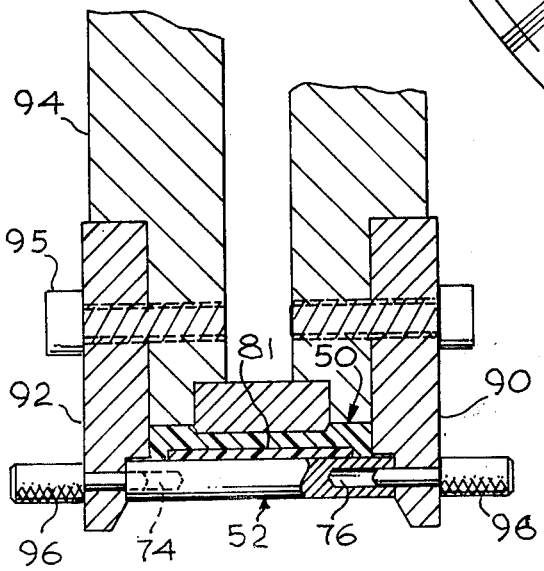
FIG. 5 is a sectional view taken substantially along the plane 5—5 of FIG. 4.

More particularly, as has been mentioned, the band 50 preferably has an I shaped cross section, best shown in FIG. 3, comprised of enlarged end portions 58, 60 and a central trough portion 62. The band 50 preferably comprises a plastic material formed around a flat steel belt 64. Secured to the band in the trough portion 62 are a plurality of spaced platforms 81. In the final assembly, each platform 81 carries a different slug 52. In order to mount and properly position each slug 52 on a platform 81 the fixture 90 of FIG. 4 is provided. Briefly, the mixture 90 is comprised of upper and lower rings 90 and 92 sandwiching a core 94 therebetween. The core 94 defines a circular cross section having a circumferential dimension substantially equal to the inner surface of the endless band 50. In order to mount the slug 52 on the platforms 81, the end ring 90 is first removed so as to permit the band to be mounted around the core 94. The end ring 90 is then fastened onto the core with bolts 95. As shown in FIG. 4, the plates 90 and 92 are provided with precisely located apertures formed therein extending around the circumference of the rings. These apertures are used to receive pins 96 for extending into the cavities in the slugs to precisely hold and position the slugs 52 relative to the flexible band 50.

Prior to inserting a slug 52 into the fixture 90, a suitable epoxy 98 is applied to the platform 81. Thereafter, the slug is positioned against the platform 81 between the locating pins 96 extending through the apertures in the rings 90 and 92 and the epoxy is permitted to set to secure the slug to the platform.

From the foregoing, it should now be appreciated that an improved type bearing assembly has been disclosed herein for use in a high speed impact printer apparatus. Use of a type bearing assembly in accordance with the present invention enables slugs to be easily installed onto a flexible band and for type modules to be simply and inexpensively installed and replaced onto the slugs.

The embodiments of the invention in which an exclusive property or privilege is claimed are defined as follows:

1. An assembly suitable for use in a printing apparatus for successively presenting type characters to a print station, said assembly comprising:

an endless band formed of plastic material having first and second edges spaced by a width dimension and inner and outer peripheral surfaces extending between said edges, said band being relatively flexible about an axis in the plane of said band parallel to said width dimension and relatively rigid about an axis in the plane of said band perpendicular to said width dimension;

low friction bearing means engaging said band inner surface and supporting said band thereon;

a plurality of elongated metal slugs, each having an end face opening into an axially directed cavity;

adhesive means fixing said metal slugs to the outer surface of said plastic band with the length of said slugs extending across the width of said band;

a plurality of metal type modules, each comprised of a head having front and rear faces;

a shank extending from the rear face of each of said type module heads, said shanks extending fully into said slug cavities to abut said slug end faces against said type module head rear faces;

at least one raised type character formed on the front face of each of said type module heads;

a heat soluble adhesive securing each type module shank within the cavity of one of said elongated metal slugs whereby heat can be applied to a selected module to dissolve said adhesive to enable the type module shank to be withdrawn from said slug cavity; and means for driving said endless band around said low friction bearing means.

2. The assembly of claim 1 wherein each of said slugs has two end faces, each opening into an axially directed cavity.

3. The assembly of claim 1 wherein said cavities and said shanks define cylindrical cross sections.

4. A printer apparatus comprising:

a hammer assembly including a plurality of hammers mounted with the impact faces thereof defining a common elongated plane and means for individually actuating each hammer to propel the impact face thereof in a first direction substantially perpendicular to said plane;

means for transporting a web material to be printed upon along a path past said common plane of impact faces; and type assembly means for successively presenting type characters to each of said hammer impact faces, said type assembly means including:

an endless band formed of plastic material having first and second edges spaced by a width dimension and inner and outer peripheral surfaces extending between said edges, said band being relatively flexible about an axis in the plane of said band parallel to said width dimension and relatively rigid about an axis in the plane of said band perpendicular to said width dimension;

a plurality of elongated metal slugs each having an end face opening into an axially directed cavity;

a plurality of metal type modules, each comprised of a head having front and rear faces;

a shank extending from the rear face of each of said type module heads, said shanks extending fully into said slug cavities to abut said slug end faces against said type module head rear faces;

at least one raised type character formed on the front face of each of said type module heads;

a heat soluble adhesive securing each type module shank within the cavity of one of said elongated metal slugs, whereby heat can be applied to a selected module to dissolve said adhesive to enable the type module shank to be withdrawn from said slug cavity;

adhesive means fixing said metal slugs to the outer surface of said plastic band with the length of said slugs extending across the width of said band and with said type module front faces lying in a substantially common plane;

low friction bearing means engaging said band inner surface and supporting said band with said plane of type module front faces oriented substantially parallel to said plane of impact faces with said web material path disposed therebetween; and means for driving said endless band around said low friction bearing means.

5. The apparatus of claim 4 wherein each slug and type module has a mass on the order of at least five times the mass of one of said hammers.

* * * * *